United States Patent [19]

Harley

[11] Patent Number: 4,781,385

[45] Date of Patent: Nov. 1, 1988

[54] BALL GAME

[75] Inventor: Gary R. Harley, Mount Macedon, Australia

[73] Assignee: Pro Cricket Pty, Ltd., Port Melbourne, Australia

[21] Appl. No.: 928,195

[22] Filed: Nov. 7, 1986

[30] Foreign Application Priority Data

Nov. 11, 1985 [AU] Australia ..... PH3351

[51] Int. Cl.[4] ..... A63B 71/02; A63B 59/06

[52] U.S. Cl. ..... 273/411; 272/3; 273/25; 273/67 D; 273/72 R

[58] Field of Search ..... 273/411, 25, 1 C, 88, 273/90, 67 D, 67 DC; 272/2, 3

[56] References Cited

U.S. PATENT DOCUMENTS

| | | | |
|---|---|---|---|
| 959,973 | 5/1910 | Tomkins | 272/3 |
| 2,683,603 | 7/1954 | Gackenbach | 273/25 X |
| 2,812,946 | 11/1957 | Hughes | 273/411 |
| 3,830,497 | 8/1974 | Peterson | 273/411 X |

FOREIGN PATENT DOCUMENTS

| | | | |
|---|---|---|---|
| 27518 | 12/1896 | United Kingdom | 273/67 DC |
| 1391120 | 4/1975 | United Kingdom | 273/67 D |

*Primary Examiner*—William H. Grieb

*Attorney, Agent, or Firm*—Hovey, Williams, Timmons & Collins

[57] ABSTRACT

Apparatus for playing an indoor ball game derived from baseball. A playing arena has a playing area surrounded by wall means such as netting walls. A games track is on the playing area and has a plurality of track bases spaced apart therealong. A game player is positioned on the playing area at a location for receiving a ball pitched thereto and progressively moves in one direction along the games track to successive track bases to obtain a score during game play. There is at least one score zone in the playing arena which, when struck by a ball during game play results in a score allocation according to game rules.

11 Claims, 3 Drawing Sheets

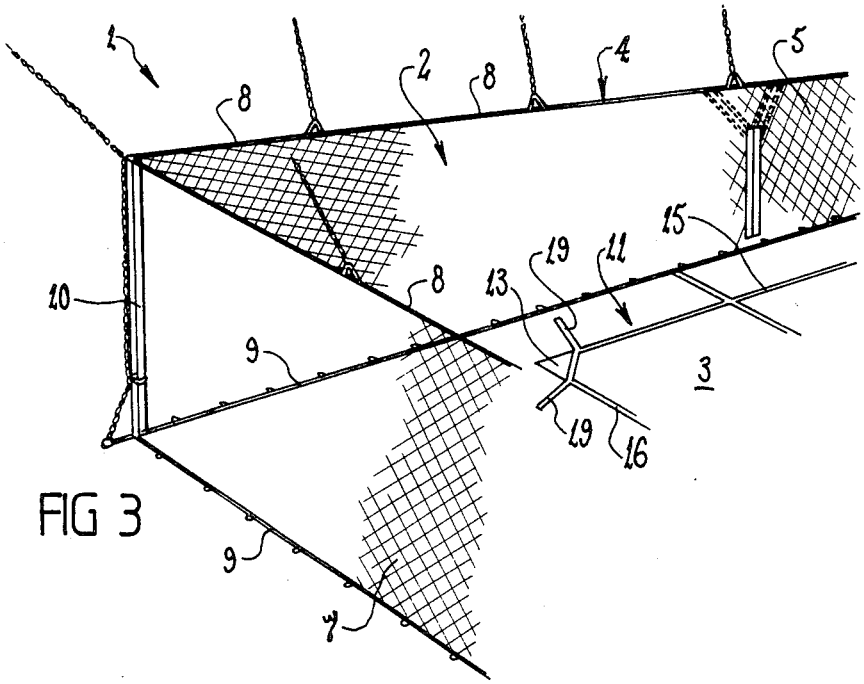
FIG 3
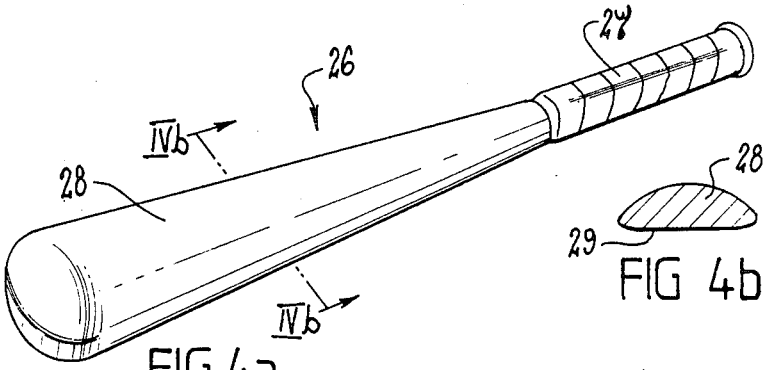
FIG 4a
FIG 4b
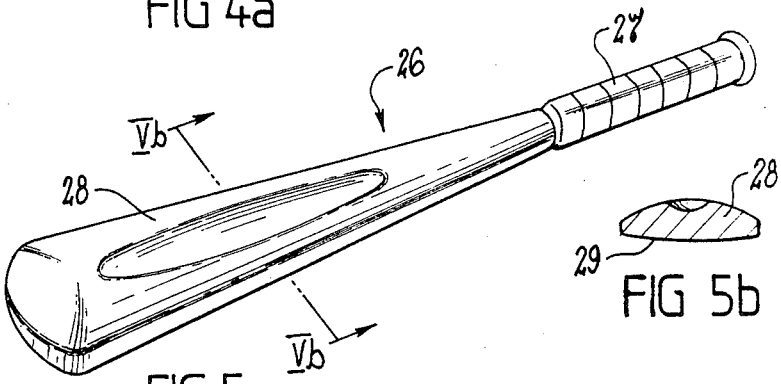
FIG 5a
FIG 5b

BALL GAME

This invention relates generally to a ball game played between opposing teams of players, and in particular to apparatus for playing that game. The game is applicable for indoor or undercover play, such as within a suitably sized pavilion, and it will be convenient to hereinafter disclose the invention in relation to that exemplary application. It is to be appreciated, however, that the invention is not limited to that application.

A variety of ball games for player teams, traditionally developed for outdoor play, are now being played indoors so that they can be played all year round. Those games include tennis and basketball. However, some games do not lend themselves to simple transposition from outdoors to indoors play. One such game is cricket, where outdoor large playing arenas are used but which cannot be readily or economically duplicated inoors. As a result, a modified form of cricket game has evolved.

A similar problem exists with softball, baseball, and like bat and ball games, and it is an object of the present invention to alleviate this problem through the provision of apparatus for playing such games indoors.

With that in mind, the present invention provides apparatus for playing an indoor ball game, including: a playing arena having a playing area surrounded by wall means; a games track on the playing area provided with a plurality of track bases spaced apart therealong, a game player being on the playing area at a location for receiving a ball pitched thereto and progressively moving in one direction along the games track to successive track bases to obtain a score during game play; and at least one score zone in the playing arena which, when struck by a ball during game play, results in a score allocation according to game rules.

The wall means preferably defines an at least generally triangular playing area in plan shape. Thus, the wall means preferably has three wall surfaces providing a boundary to the playing area. Preferably, those wall surfaces are at least substantially planar and extend generally vertically from the playing area.

The playing area is preferably hard and level, and extends at least substantially horizontally.

The games track is preferably shaped so as to be endless, with the track bases being spaced thereabout. That track can be triangular shaped like the playing area with the track bases located at each apex of the games track between straight track sections. Thus, during game play, a player running entirely along the track will commence from the one track base and pass each other base to eventually return to the one base. The games track may be located toward one apex of the triangular playing area, with the area toward the other apexes being generally clear of that games track. During game play with the apparatus, a bat is held by a game player for striking the pitched ball. The bat is preferably elongate. A handle portion is preferably located toward one end for gripping by a batting player whilst a striking portion is located toward the other end for striking a pitched ball. Preferably, the striking region has a striking face against which the pitched ball is struck. That surface is preferably generally flat. The bat is preferably of a rigid construction.

During game play with the apparatus, the ball is pitched by a games player from a pitching base in the playing area. That pitching base is preferably spaced from the game track. In particular, that base is preferably located outside that region of the playing area occupied by the endless track. Moreover, the pitching base is preferably located so that the track is positioned generally between the track base at which a pitched ball is struck with the bat, and the pitching base.

Preferably, the or at least one score zone is provided at or on one of the boundary wall surfaces. The or one score zone is preferably located toward the top of the wall surfaces, or at least spaced apart from the playing area. The score zone(s) are preferably located somewhat remove from the games track, and in particular remote from the one track base at which a pitched ball is struck with the bat.

The apparatus preferably provides a series of score zones within the playing arena, spaced about the wall surfaces. Those score zones are preferably indicated by boundary lines marked on the playing area and/or the wall surfaces.

A ball game is preferably played using the above apparatus according to a predetermined set of rules. Those rules will preferably provide for the game to be played between two opposing teams of players, the aim of each team being to obtain a better score than the other team and thereby win the game. In that regard, the teams preferably take turns to bat (the batting team), and pitch and field the ball (the pitching team). Preferably, the rules will provide when and how each team can score through a game, as well as score values. In that regard, preferably scores are registered to team players in the form of points or runs, with the team having the higher point tally at the end of the game winning.

In particular, the set of rules preferably provides the manner in which a batting team can score points, and the number of points scored. In that regard, preferably one or more points are scored by the batting players team for balls directly or indirectly striking the scoring zone(s). The rules also preferably provide for one or more points to be scored by batting team players running entirely along the games track.

The set of rules preferably also provides the manner in which the pitching team can prevent the batting team from scoring points and/or can have score points deducted from the score of the batting team.

The set of rules may further provide for one or more points to be scored by or deducted from one or other team as a result of an error in play on the part of that and/or the other team.

The following description refers to a preferred embodiment of the apparatus and ball game of the present invention. To facilitate an understanding of the invention, reference is made in the description to the accompanying drawings where the apparatus is illustrated. It is to be understood that the invention is not limited to the embodiment as hereinafter described and as illustrated.

In the drawings:

FIG. 3 is a detailed perspective view of a portion of the apparatus of FIG. 1;

FIG. 4*a* is a perspective view of one preferred bat used in the game of the present invention;

FIG. 4*b* is a cross sectional view through section ivb—ivb of the bat of FIG. 4*a;*

FIG. 5*a* is a perspective view of an alternative preferred used in the game of the present invention; and FIG. 5*b* is a cross sectional view through section vb—vb of the bat of FIG. 5*a*.

Figure 1:
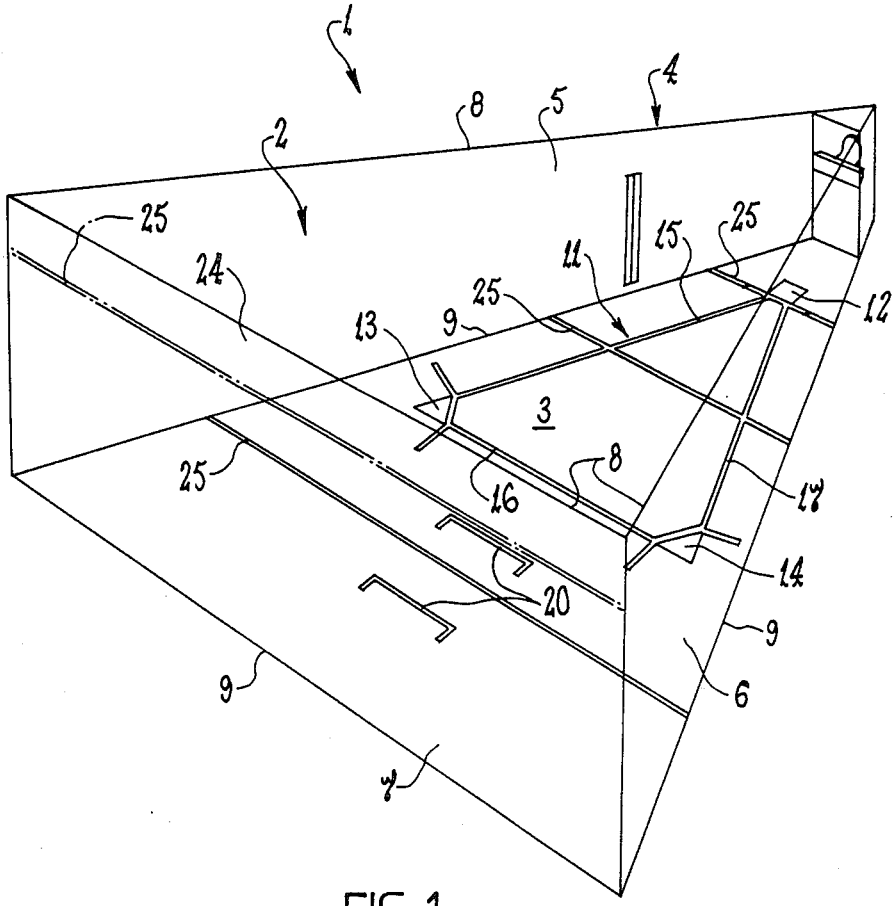
FIG. 1 is a schematic perspective view showing part of the apparatus of the present invention.
Figure 2:
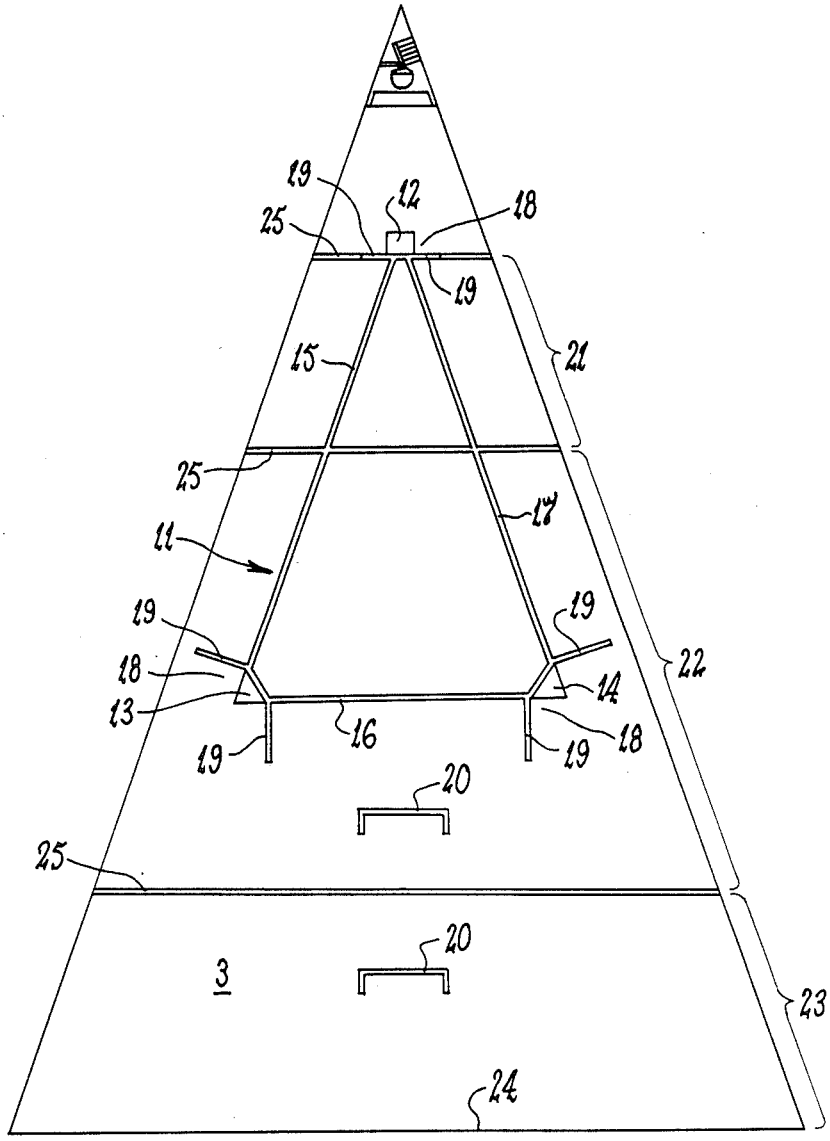
FIG. 2 is a schematic top plan view of the apparatus of FIG. 1.

Referring initially to FIGS. 1 and 2, there is illustrated much of apparatus 1, used for playing the indoor ball game. Apparatus 1, includes playing arena 2, having playing area 3, surrounded by wall means 4. Wall means 4, defines the outline of a triangular playing area 3, and includes three boundary side walls 5,6,7, erected on area 3. Those boundary walls 5,6,7, may be removably so erected, so that apparatus 1, may be generally dismantled when the game is not being played. Walls 5,6,7, are generally flexible so that they can act to stop a ball with minimal rebound during game play. Such walls 5,6,7, may also minimise player injury when contacted.

Boundary walls 5,6,7, are illustrated in further detail in FIG. 3 and may be composed of flexible sheet material suspended and held taut above playing area 3. That suspension may be from a support structure (not illustrated), which in the example application may be part of a building in which apparatus 1, is housed. Suspension may be from top edge 8, of boundary walls 5,6,7, whilst bottom edge 9, thereof may be secured against playing area 3. Further support for walls 5,6,7, may be provided by support posts 10, particularly located at corners formed between juxtaposed walls 5,6,7,. As illustrated, the flexible sheet material of walls 5,6,7, may be in the nature of webbing or netting. Openings within that material should be sufficiently small to prevent the passage of a ball therethrough during game play.

Boundary walls 5,6,7, may be of any suitable length and height. Two adjacent walls 5,6, may be of equal length and relatively long, whilst remaining wall 7, may be of a relatively shorter length. Thus, walls 5,6,7, may provide playing area 3, with a shape of an isosceles triangle. All boundary walls 5,6,7, may be of the same height although in this embodiment walls 5,6, will slope upwardly along top edge 8, thereof toward wall 7. In the example application of apparatus 1, walls 5,6, may be about 30 meters long, and increasing in height from about 4.2 to 6 metres, and wall 7, about 20 meters long, and about 6 meters high.

Although not illustrated, playing area 3, may be generally covered over with a top wall extending between two edges 8, of boundary side walls 5,6,7. That top wall may be provided by a ceiling of the building housing apparatus 1, of flexible sheet material the same or similar to that providing boundary side walls 5,6,7.

Playing area 3, may be provided on a foundation of any suitable construction, and have a playing surface of suitable material. In the example application of apparatus 1, the foundation is provided by a building floor, which may be constructed of concrete, timber, or synthetic grass. Alternative playing areas 3, are envisaged, particularly where apparatus 1, is located outdoors.

Located on playing area 3, is games track 11, provided with three track bases 12,13,14, spaced apart therealong. Games track 11, and track bases 12,13,14, are marked on or in playing area 3. That marking may be achieved by painting thereon.

Games track 11, is triangular in shape, thereby providing three straight track sections 15,16,17, interconnecting bases 12,13,14, at apexes of track 11. Conveniently, the track shape is the same as, but proportionately smaller than, the playing area shape in the sense of having two adjacent rack sections 15,17, (the side track sections) of equal longer length and remaining track section 16, (the end track section) of relatively shorter length. Moreover, games track 11, has an orientation corresponding to that of playing area 3, and is located toward the playing area apex formed between longer boundary side walls 5,6.

Track sections 15,16,17, are of any suitable length having regard to size of playing area 3. In the example application of apparatus 1, the side track sections 15,17, may be about 12 meters long, whilst the end track section may be about 8 meters long. Track 11, may be located so that the apex between side track sections 15,17, is about 5 meters from the apex between side walls 5,6.

Track bases 12,13,14, may be of any suitable size. In the example application of apparatus 1, bases 12,13,14, may each be quadrangular or triangular and have side lengths of about 450 millimeters.

Games track 11, may have safety zones 18, adjacent track bases 12,13,14, in which a batting game player running along track 11, is "safe" during the game. To that end, track 11, may have pairs of crease lines 19, extending across track 11, adjacent each of bases 12,13,14, safety zones 18, extending between crease lines 19, of each pair through adjacent base 12,13,14, Crease lines 19, may be marked on or in the playing area 3. That may be achieved by painting crease lines 19, on area 3.

Apparatus 1, also includes at least one pitching base 20, in playing area 3, at which a game player is located for pitching a ball during game play. As illustrated two such bases 20, may be provided for, use by players of different game skill levels. Pitching bases 20, are located between games track 11, and boundary wall 7. Thus, pitching bases 20, may be located between track section 16, and boundary side wall 7, and are located on an imaginary line extending from track base 12, and generally bisecting triangular games track 11.

Pitching bases 20, may be located at any suitable distance from track base 12, having regard to the overall size of playing area 3. That distance may vary between games, so that the distance may be greater for games between more experienced players. In the example application of apparatus 1, that distance may be from about 14 to 18 meters.

Pitching bases 20, are marked on or in playing area 3. That may be achieved by painting bases 20, thereon.

Arena 2, is provided with core zones 21,22,23,24, so that when a ball strikes any one of those zones scores are allocated. Those zones 21,22,23,24, are provided on inner surfaces of walls 5,6,7, and are conveniently marked with lines 25, on the wall inner surfaces and/or on playing area 3. Thus, zones 21, and 22, each extends partly along both side walls 5,6, between edges 9, and 10, zone 23, extends partly along both side walls 5,6, between edges 9, and 10, as well as entirely along side wall 7, from bottom edge 9, toward top edge 8, where zone 24, is located.

Score zones 21,22,23,24, may be of any suitable shape and size having regard to the shape and size of walls 5,6,7.

It should be appreciated that other and/or alternative score zones may be provided, and may include for example, regions of playing area 3, between base 12, and the apex between walls 5,6, and between various ones of bases 12,13,14. Still other score zones may include specific areas along boundary side walls 5,6,7, those areas being limited to certain heights above playing area 3.

The ball game of the present invention is played with a bat and ball. That bat and ball may be of any conventional type suitable for playing a ball game in a confined arena as described above, for example, a bat as used in baseball, softball, or cricket and a ball as used in tennis. Alternatively, specifically developed bats and balls may be used. Two embodiments of such bats are illustrated in FIGS. 4 and 5.

FIGS. 4 and 5 illustrate bats 26, each having short cylindrical handle portion 27, and generally flatened striking portion 28. Striking portion 28, has striking surface 29, with which a ball is struck during game play. Striking surface 29, is slightly convex, and may increasingly taper in a direction away from handle portion 27. Bat 26, may be composed of any suitable material, such as wood, metal, or plastic. During game play, bat 26, may be held upright in readiness for striking a pitched ball, in the manner of a softball or baseball bat.

A ball game using apparatus 1, as outlined above is played between two opposing teams, typically each of six players, according to a set of rules. Designation of batting and pitching teams may be achieved through any equitable manner, such as through the toss of a coin.

The set of rules provides for the batting team to have two batting innings, the innings alternating between the teams. During each batting innings, half of the batting team (active players) bat together. Those players of the batting team not batting in any one innings (passive players) wait outside arena 2. Each batting innings, is limited to a predetermined number of balls pitched by the pitching team, for example 36 balls. All active players of the batting team play together throughout the entire innings of that half team, so that there is not the sequential batting as each player goes "out" usually associated with bat and ball games; there is no "out" player in the usual sense.

According to the rules, when actually batting each active player of the batting team is permitted to stand on track base 12, and receive balls pitched from one pitching base 20, by a player of the pitching team. The other two active batting players of that team, while not batting, stand on track base 13, and 14, respectively. When a fairly pitched ball is correctly struck by the actually batting active player, all active players may or must (depending on the rules) run along games track 11, to successive bases 12,13,14. During each run those players may run only to the next successive base 12,13,14, thereby bringing the active batting players to base 12, in succession. Only one active batting player may stop on any bases 12,13,14, at any one time, thus all active players are required to move along track 11, together.

The rules provide that an active batting player who correctly strikes a fairly pitched ball and runs to reach base 13, safely shall be credited one or more score points according to the point value allocated to the scoring zone 21,22,23,24, that the ball may have first hit (either directly off the bat or indirectly such as off playing area 3). In addition, those players may be credited with one or more additional points, according to the rules, should they subsequently advance from base 13, through base 14, back to base 12. At least one score zone, such as zone 24, may be further distinguished as a bonus score zone by the rules in that, when a struck ball first hits that zone, all active batting players may freely walk to the next successive base 12,13,14, with the active player achieving that zone hit being credited with the point value of that zone 24.

The set of rules provide for the pitching team to have two pitching innings during which each player in turn pitches the ball from pitching base 20, to a batting player at track base 12, and fields the ball. During each innings, all players of the pitching team are positioned on playing area 3, and attempt to prevent the batting team players from scoring points. The pitching team players may be arranged on playing area 3, so that one player is on pitching base 20, separate players are adjacent each of track bases 12,13,14, and the remaining players are on playing area 3, remote from games track 11. The rules may require curtain pitching player placement.

When pitching during a game, each player is permitted to pitch a predetermined number of balls, for example, twelve balls subdivided into two non-consecutive six ball overs, one over being pitched during each batting team innings. A fairly pitched ball may be thrown underarm from closer pitching base 20, or overarm from more remote pitching base 20, according to the rules. Moreover, a fairly pitched ball may not bounce or hit a boundary side wall 5,6,7, or top wall, before reaching the batting player at base 12. According to the rules a fairly pitched ball is required to pass over base 12, between the batting player's knees and shoulders when in a natural batting stance.

The set of rules provides for the teams to have score points deducted as a result of errors of play by that team, when batting and/or pitching. Thus, for example, the batting team may have one or more points deducted where an active player when batting does not swing and attempt to strike a fairly pitched ball, and a predetermined (such as three) balls are fairly pitched to the same active player without the ball being struck. In addition, batting team points may be deducted where a struck ball is fielded and held by a pitching team player standing on one of track bases 12,13,14, before an approaching active player of the batting team reaches that base 12,13,14, and where a struck ball is caught by a pitching team player before that ball touches playing area 3, whether or not the ball has previously struck side walls 5,6,7, or the top wall. Batting team score points may also be deducted where a player of that team interferes with the fielding of any ball.

The set of rules provides for the teams to score points as penalties resulting from errors of play by the other team when batting and/or pitching. Thus, for example, the batting team may score one or more points where a ball or succession of balls are not fairly pitched by the pitching team, the pitching team players are not properly positioned on area 3, a pitched ball strikes an active player when at base 12, the pitching team players interfere with the active players when actually batting and running along games track 11, through a misfielding of the ball, and the pitching team are not generally playing within the "spirit of the game".

The rules may provide for an umpire to adjudicate during a game. That umpire may be positioned on playing surface 3, between base 12, and apex between side walls 5,6, in a non-score or foul zone. The umpire may score points for or against the opposing teams for any number of predetermined reasons, such as abuse of game apparatus, dangerous game play, kicking the ball, foul play, or any unbecoming action.

The set of rules may further include usual guidelines to achieve orderly game play as will be well appreciated by those skilled in this art.

The apparatus of the present invention provides an exciting ball game that can be played indoors between opposing teams of players. That game can simulate softball, baseball and like games and provide player and spectator enjoyment traditionally associated with such games.

Finally, it is to be appreciated that various modifications and/or alterations may be made to the apparatus without departing from the ambit of the invention as defined in the claims appended hereto.

Having now described my invention what I claim as new and desire to secure by Letters Patent is:

1. An indoor ball game played between teams of oppsing players comprising:

a playing arena having a triangularly shaped playing area on which team players stand during game play;

wall means providing upright boundary walls extending completely along boundary edges of the playing area, the walls being formed of netting material held taut;

three bases located on the playing area in a triangular formation so as to define a triangularly shaped endless games track having straight track sections extending between adjacent bases, the games track arranged with the track sections extending parallel to respective boundary edges of the playing area and arranged offset the playing area so as to be closer to one apex of that area, that one of the bases closest to the one apex of the playing area being designated a batting base at which a game player is positioned for receiving and striking a ball pitched thereto from another game player on the playing area before progressively moving in one direction along the games track to successive bases in order to obtain a score during game play; and a series of score zones having different score values spaced about the walls which, when hit by a ball struck by a game player at the batting base during game play, results in a respective score allocation according to game rules.

2. A ball game as claimed in claim 1, and further including a pitching base on the playing area at which the other game player pitches the ball to the game player at the batting base for striking.

3. A ball game as claimed in claim 2, wherein the pitching base is located outside the endless games track.

4. A ball game as claim in claim 1, wherein the score zones are positioned forwardly of the batting base, with different value score zones being positioned at different distances from that batting base.

5. A ball game as claimed in claim 1, wherein at least two score zones are positioned at relatively different heights.

6. A ball game as claimed in claim 1, wherein the score zones are indicated by boundary lines marked on the playing area.

7. A ball game as claimed in claim 1, wherein the score zones are indicated by boundary lines marked on the wall surfaces.

8. A ball game as claimed in claim 1, wherein the wall means includes a top wall extending over the playing surface so that the playing area is completely enclosed, the top wall also being formed of netting material.

9. A ball game as claimed in claim 8, wherein the top wall slopes upwardly generally forwardly from above the batting base.

10. A ball game as claimed in claim 1, wherein adjacent each base a pair of crease lines are provided, one on each side of the base and between which a game player is safely located during game play.

11. An indoor ball game played between teams of opposing playing comprising:

a playing area having a triangular shaped playing area on which team players stand during game play;

wall means providing upright boundary walls extending completely along edges of the playing area and a top wall extending over the playing surface so that the playing area is completely enclosed, the top wall sloping upwardly generally forwardly from adjacent one apex of the triangular shaped playing area, all of the walls being formed of netting material held taut;

three bases located on the playing area in a triangular formation so as to define a triangular shaped endless games track having straight track sections extending between adjacent bases, the games track arranged with the track sections extending parallel to respective boundary edges of the playing area and arranged offset on the playing area so as to be closer to the one apex of the triangular shaped playing area than to the other apexes of that area, that one of the bases closes to the one apex of the playing area being designated a batting base at which a game player is positioned for receiving and striking a ball pitched thereto before progressively moving in one direction along the games track to successive bases in order to obtain a score during game play;

a pitching base located on the playing area outside the games track remote from the batting base and at which another game player pitches the ball to the game player at the batting base for striking; and four score zones having different score values spaced about on the walls, the score zones being positioned forwardly of the batting base, with different value score zones being positioned at different distances from that batting base, and at least two of the score zones being positioned at relatively different heights on the same wall, the score zones when hit by a ball struck by a game player at the batting base during game play, resulting in a respective score allocation according to game rules.

* * * * *